United States Patent [19]

Layciak et al.

[11] 4,427,853

[45] Jan. 24, 1984

[54] CONVERTIBLE MOMENTARY/MAINTAINED ELECTRIC SWITCH

[75] Inventors: Stephen G. Layciak, Brighton Township, Beaver County; Robert J. Johnston, Patterson Heights; Dominic Colista, Harmony Township, Beaver County, all of Pa.

[73] Assignee: Westinghouse Electric Corp., Pittsburgh, Pa.

[21] Appl. No.: 371,387

[22] Filed: Apr. 23, 1982

[51] Int. Cl.[3] ..... H01H 9/20

[52] U.S. Cl. ..... 200/50 C; 200/5 E

[58] Field of Search ..... 200/50 C, 5 E, 318, 200/321; 74/483 PB

[56] References Cited

U.S. PATENT DOCUMENTS

| | | | |
|---|---|---|---|
| 3,710,288 | 1/1973 | Grunert | 200/50 C |
| 4,177,363 | 12/1979 | Keranen | 200/50 C |
| 4,250,368 | 2/1981 | Johnston et al. | 200/307 |
| 4,282,414 | 8/1981 | Johnston et al. | 200/160 |
| 4,356,363 | 10/1982 | Harbauer et al. | 200/50 C |

*Primary Examiner*—E. A. Goldberg
*Assistant Examiner*—Morris Ginsburg
*Attorney, Agent, or Firm*—Benjamin Hudson, Jr.

[57] ABSTRACT

There is provided by this invention an interlock mechanism for converting two momentary electric control switches to the maintained control mode that is generally comprised of a single extension spring biasing the interlock mechanism in its last selected operating position.

1 Claim, 3 Drawing Figures

CONVERTIBLE MOMENTARY/MAINTAINED ELECTRIC SWITCH

BACKGROUND OF THE INVENTION

1. Field of the Invention

This invention relates generally to electric control pilot switches and more particularly to electric control pilot switches having interlock mechanisms for converting a momentary mode control switch to a maintained mode control switch.

2. Description of the Prior Art

In industrial electrical control applications electrical control switches are used for varying operating modes in which different switch designs are used for a particular control mode. Recently, the trend of industrial control engineers has been to design control switches so that they may be converted to accommodate a variety of operating modes. One example of such a switch is disclosed in U.S. Pat. No. 4,282,414 issued to Robert J. Johnston, et al., and assigned to the assignee of the present application. This patent teaches a convertible switch operator for use as a pull momentary switch mode or a push-pull momentary switch mode. Other convertible elements of control switches are well known to the art such as convertible contacts from normally opened functions to normally closed functions and vice versa. It would also be desirable if there was provided a convenient and simple conversion technique to change a momentary electric switch to a maintained electric switch.

SUMMARY OF THE INVENTION

There is provided by this invention a novel and simple interlock mechanism that can be conveniently added to a momentary electric switch for conversion to a maintained electric switch device. The advantage of this new interlock mechanism is that it provides momentary and maintained operating functions with a simple structure having a minimum of parts.

DESCRIPTION OF THE PREFERRED EMBODIMENT

Figure 1:
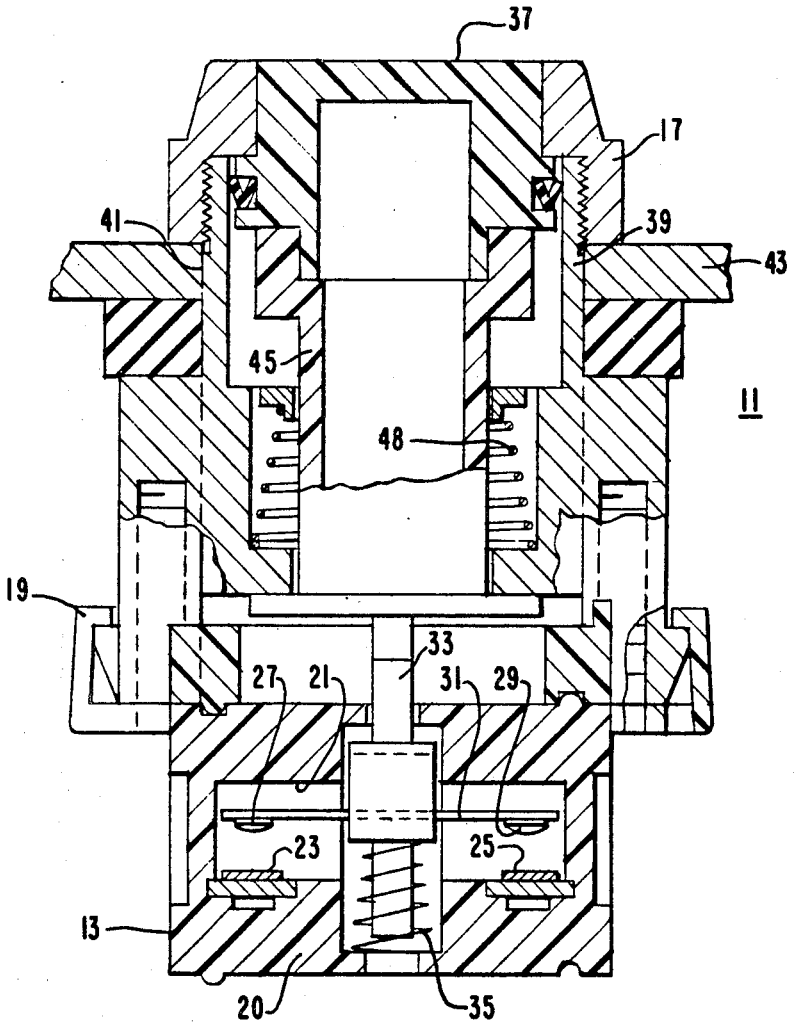
FIG. 1 is a vertical sectional view showing an electric control switch.

In FIG. 1, an electric switch structure is generally indicated at 11 and it comprises a contact block 13, and control operating unit 17. The electric switch structure disclosed is of the type described in U.S. Pat. No. 4,250,368 issued to Robert J. Johnston, et al. Inasmuch as a detailed description of the electric switch structure is disclosed in the aforementioned patent to which reference is made to incorporate the complete description of structure and operation, the description is limited to the parts that are essential to the operation of the invention disclosed herein.

The contact block 13 comprises an electrically insulating housing 20 which forms a compartment 21 in which pairs of stationary contacts 23 and 25 are mounted. Corresponding movable contacts 27 and 29 are mounted on a rigid bridging contact carrier 31. The contact carrier 31 is mounted on a plunger 33 and a coil spring 35 maintains the plunger in the uppermost position so that the contacts in the contact block 13 are in the normally opened position.

Operating unit 17 comprises a pushbutton 37 mounted within a casing 39 which extends through a hole 41 in a panel wall 43. The pushbutton 37 is mounted on the upper end of tubular actuator 45 and is attached at the lower end of the actuator. A coil spring 48 retains the pushbutton and the actuator in the position shown. When the pushbutton 37 is depressed the plunger 33, in contact with the actuator 45 is likewise depressed whereby the several contacts 23–29 in the contact block 13 are closed. An adapter 19 is disposed between the unit 17 and the contact block 13 to facilitate latching and delatching of the contact block onto the unit.

Figure 2:
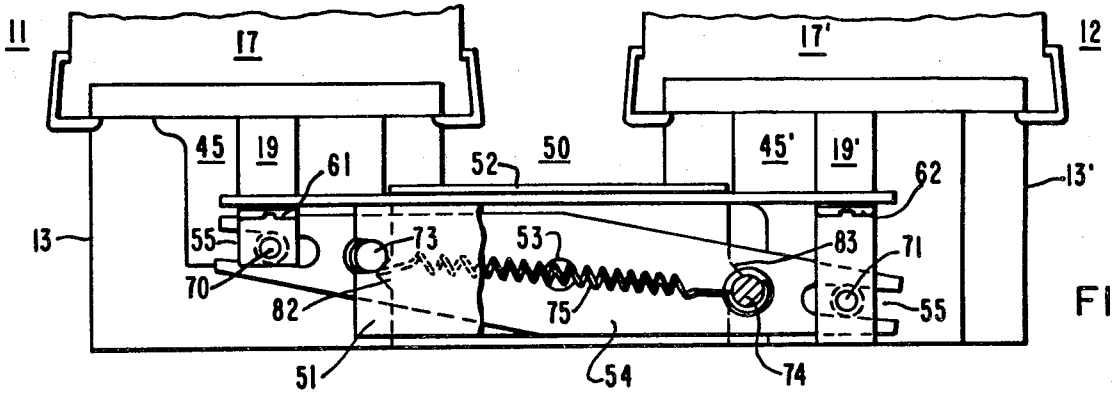
FIG. 2 is a partial rear view of the actuators of two electric control switches similar to the one shown in FIG. 1 with an interlock mechanism attached incorporating the principles of this invention.
Figure 3:
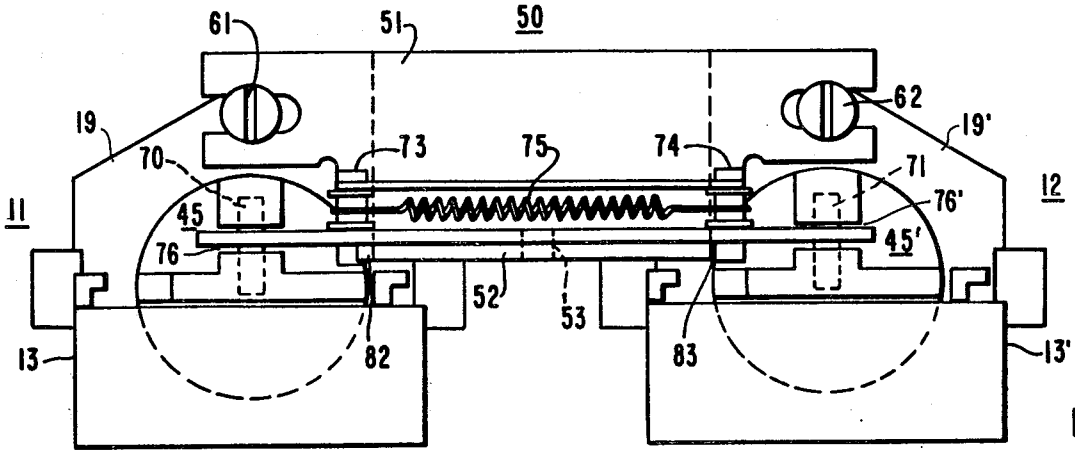
FIG. 3 is a bottom view of the interlock mechanism attached to the electric control switches shown in FIG. 2.

In accordance with the principles of this invention there is shown in FIGS. 2 and 3 two electric control switches 11 and 12 similar to one described in FIG. 1 having an interlock mechanism 50 supported by the adapters 19 and 19' of the two electric control switches by means of two screws 61 and 62. The interlock mechanism 50 is generally comprised of a first L-shaped support bracket 51 having a second L-shaped support bracket 52 welded, riveted or otherwise attached thereto such that the combination of the two forms a generally U-shaped cavity. Mounted to the second L-shaped support bracket 52 within the generally U-shaped cavity by means of a pivot pin 53 is an interlock lever 54. The interlock lever 54 has slot means 55 at each of its ends that allows it to be connected to the tubular actuators 45 and 45' of the operating units 17 and 17' by means of pins 70 and 71 mounted in slotted openings 76 and 76' the tubular actuators 45 and 45'. Two latching pins 73 and 74 pass through the first L-shaped support member 51 and the interlock lever 54. The two latching pins 73 and 74 support an extension spring 75 that is disposed to lock the interlock mechanism in the maintain mode. The second support bracket 52 has small projections 82 and 83 over which the pins 73 and 74 move to maintain the interlock mechanism's last position.

When either one of the pushbuttons 37 is depressed the movement of the actuators 45 and 45' cause the interlock lever 54 to move the latching pins 73 or 74 over the projections 82 and 83 while the extension spring 75 supplies sufficient bias to prevent the pins 73 or 74, the interlock lever 54, and the actuators 45 and 45' from returning to their last position. To convert the two pushbuttons to a momentary control mode the mounting screws 61 and 62 need only be removed to disengage the interlock mechanism 50 from the two operating units.

It can be readily seen that there is provided by this invention a novel electric control switch having a simple and convenient interlock mechanism that allows two pushbuttons to be converted from momentary control modes to a maintained control mode.

Although there has been illustrated and described a specific embodiment, it is clearly understood that the same were merely for purposes of illustration and that changes and modifications may be readily made therein by those skilled in the art without departing from the spirit and scope of this invention.

What we claim is:

1. An electric control switch, comprising:

(a) at least two pushbutton units each having a plurality of stationary and movable contacts;

(b) each pushbutton unit having movable actuating means for operating the plurality of stationary and movable contacts between opened and closed positions to control an electric circuit;

(c) an interlock means connected between the movable actuating means of each pushbutton unit for allowing the movable actuating means to be operated individually, but not simultaneously;

(d) the interlock means comprising an interlock lever movable about a pivot point and connected at each end to the movable actuating means of the pushbutton units whereby during operation of one movable actuating means to one operating position the interlock lever is disposed to cause operation of the other movable actuating means to an inverse operating position;

(e) the interlock lever having latching pins passing therethrough at opposite ends thereof and a biasing spring connected between the latching pins; and (f) the interlock means being further comprised of support brackets for supporting and mounting the interlock lever between the two pushbutton units, the support brackets having projections thereon over which the latching pins must pass when the interlock lever moves between operating positions such that the biasing spring forces the latching pins against the projections to maintain the interlock lever and the movable actuating means connected thereto in their last selected operating position.

* * * * *